US006494693B1

(12) United States Patent
Sundén

(10) Patent No.: US 6,494,693 B1
(45) Date of Patent: Dec. 17, 2002

(54) PERISTATIC PUMP

(75) Inventor: Bengt Sundén, Stockholm (SE)

(73) Assignee: Cole-Parmer Instrument Company, Vernon Hills, IL (US)

( * ) Notice: Subject to any disclaimer, the term of this patent is extended or adjusted under 35 U.S.C. 154(b) by 0 days.

(21) Appl. No.: 09/698,813

(22) Filed: Oct. 23, 2000

(51) Int. Cl.[7] ..... F04B 43/08; F04B 43/12

(52) U.S. Cl. ..... 417/477.7; 417/477.9; 417/474

(58) Field of Search ..... 417/477.7, 477.8, 417/477.9, 477.11, 477.1, 477.3, 474

(56) References Cited

U.S. PATENT DOCUMENTS

| | | | | |
|---|---|---|---|---|
| 14,778 A | | 4/1856 | Root | |
| 1,752,810 A | * | 4/1930 | Romig | 417/477.12 |
| 2,123,781 A | | 7/1938 | Huber | 417/477.12 |
| 2,519,642 A | | 8/1950 | Ford | 417/477.12 |
| 2,885,966 A | * | 5/1959 | Ford | 103/149 |
| 3,105,447 A | | 10/1963 | Ruppert | 417/477.12 |
| 3,591,319 A | * | 7/1971 | Shlisky | 417/477 |
| 3,875,970 A | | 4/1975 | Fitter | 138/110 |
| 3,918,854 A | * | 11/1975 | Catarious et al. | 417/477 |
| 4,288,205 A | | 9/1981 | Henk | 417/477 |
| 4,487,604 A | | 12/1984 | Iwatschenko et al. | 604/153 |
| 4,558,996 A | * | 12/1985 | Becker | 417/374 |
| 4,673,334 A | * | 6/1987 | Allington et al. | 417/53 |
| 4,705,464 A | * | 11/1987 | Arimond | 417/477 |
| 5,024,586 A | * | 6/1991 | Meiri | 417/477 |
| 5,037,274 A | | 8/1991 | Holmes et al. | 417/53 |
| 5,067,879 A | | 11/1991 | Carpenter | 417/472 |
| 5,482,447 A | * | 1/1996 | Sunden et al. | 417/477.12 |
| 5,693,020 A | | 12/1997 | Rauh | 604/151 |
| 5,709,539 A | | 1/1998 | Hammer et al. | 417/477.3 |
| 5,759,017 A | * | 6/1998 | Patton et al. | 417/477.9 |

FOREIGN PATENT DOCUMENTS

| | | |
|---|---|---|
| DE | 3322843 A1 | 1/1985 |
| EP | 0 470 033 B1 | 1/1997 |
| FR | 2 413 095 | 7/1979 |
| GB | 1 296 749 | 6/1970 |

OTHER PUBLICATIONS

Derwent English Abstract for FR 2 413 095.
International Search Report, 3 pages.

* cited by examiner

*Primary Examiner*—Cheryl J. Tyler
*Assistant Examiner*—Han L. Liu
(74) *Attorney, Agent, or Firm*—Rader, Fishman & Grauer PLLC

(57) ABSTRACT

An improved peristaltic pump using a pumptube comprising a single tube of a relatively rigid and hard fluoroplastic material, preferably relatively rigid and hard polytetrafluoroethylene (PTFE), and a roller strap located between the pressure rollers of the peristaltic pump and the pumptube, is provided. The roller strap prevents direct contact between the pressure rollers of the peristaltic pump and the pumping section of the pumptube. The pumping section of the pumptube is formed or shaped into a flattened, oval-like shape which approximately conforms to the pumptube passageway in the peristaltic pump. The pressure rollers contact the roller strap and then compress the flattened side of the pumptube and, thereby, effecting transport or pumping of the fluid. The use of the strap prevents excessive tube expansion at the output back-pressure, thereby increasing the lifetime of the pumptube. Using the pumptubes and peristaltic pumps of this invention, corrosive, viscous, sensitive, biological, and/or high pressure fluids can be readily handled. The pumptube and peristaltic pumps of this invention are especially adapted to operate against high back- or counter-pressures.

36 Claims, 5 Drawing Sheets

Figure 6A
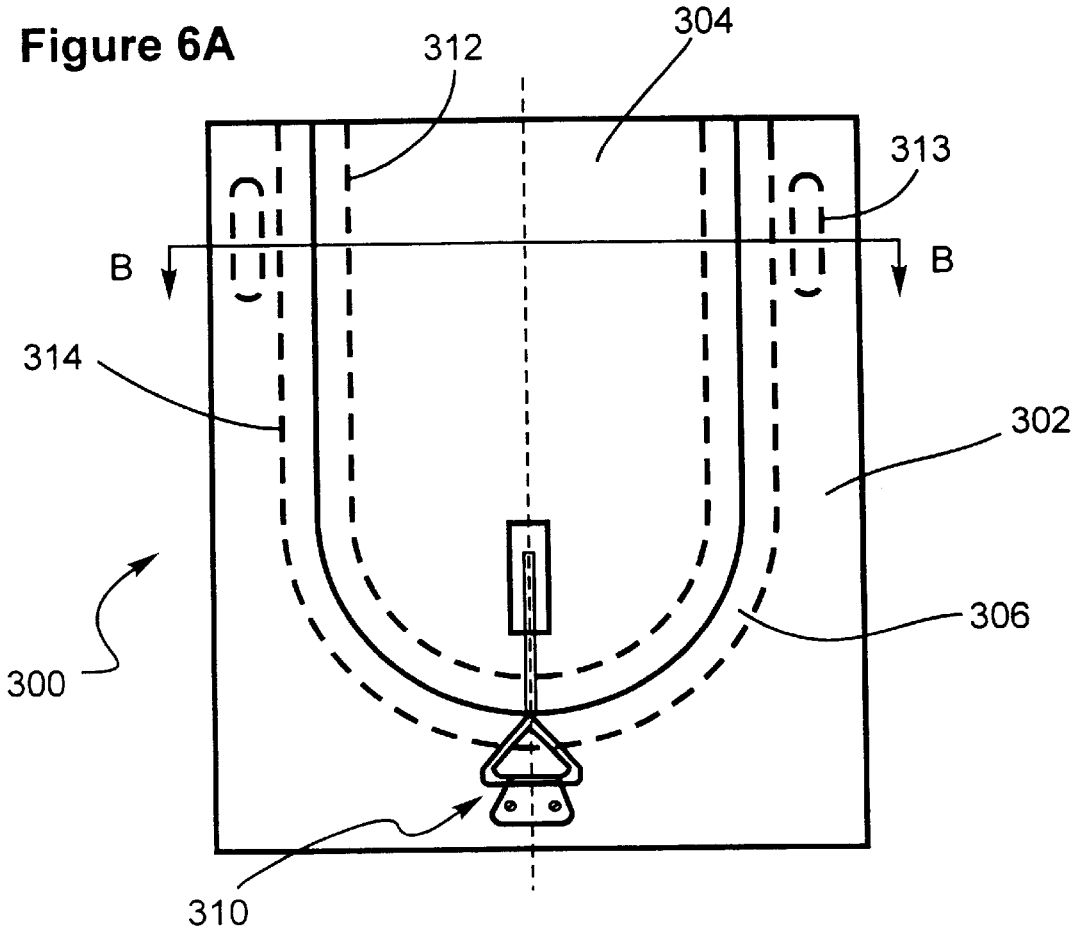
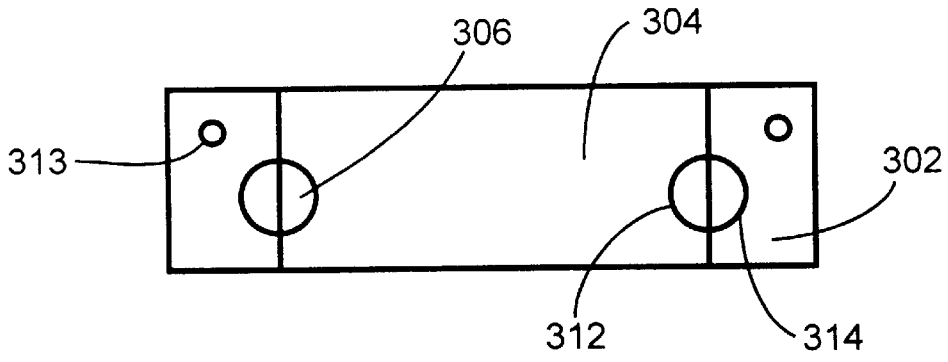
Figure 6B

PERISTATIC PUMP

FIELD OF THE INVENTION

This invention generally relates to peristaltic pumps for transporting or pumping fluids. More specifically, this invention relates to an improved peristaltic pump using a pumptube comprising a single tube of a relatively rigid and hard fluoroplastic material, preferably relatively rigid and hard polytetrafluoroethylene (PTFE), and a roller strap located between the pressure rollers of the peristaltic pump and the pumptube. The pumping section of the pumptube, which is not directly contacted by the pressure rollers of the peristaltic pump, is pre-formed or shaped into a flaftened cross section with an overall U-shape which approximately conforms to the pumptube passageway in the peristaltic pump. The pressure rollers contact the roller strap and then compress the flattened side of the pumptube and, thereby, effect transport or pumping of the fluid. The use of the strap prevents excessive tube expansion at the output back-pressure, thereby increasing the lifetime of the pumptube. Using the pumptubes and peristaltic pumps of this invention, corrosive, viscous, sensitive, biological, and/or high pressure fluids can be readily handled. Moreover, fluids up to about 50° C. can be pumped at a back-pressure up to about 4 bar; higher operating temperatures may be possible with lower back-pressures. The pumptube and peristaltic pumps of this invention are especially adapted to operate against high back- or counter-pressures.

BACKGROUND OF THE INVENTION

Peristaltic pumps are preferred for certain applications where it is desirable to pump measured amounts of a fluid or to pump a fluid through tubing while avoiding contact between pump components and the fluid being pumped. In a typical peristaltic pump system, a length of tubing is contacted by a series of pressure rollers that rotate in a circular path. The pressure rollers contact and progressively compress a flexible pumptube at spaced intervals against a surface or raceway so as to flatten or locally reduce the cross-sectional area of the fluid passageway in the pumptube. Preferably, the cross-sectional area of the fluid passageway is effectively reduced to zero (i.e., complete occlusion) as each pressure roller moves over the pumping section of the pumptube. As the pressure rollers continue to roll over the pumptube, the successive flattened portions expand or return to the original cross-sectional area due to the resilience of the tube which generates a sub-atmospheric pressure in the fluid passageway to draw the fluid therein.

The efficiency and operating characteristics of a peristaltic pump generally depend on the physical and chemical characteristics of the pumptube. The pumptube generally must have a combination of properties including flexibility, resilience, durability, resistance to creasing, and resistance to adverse chemical or physical effects, since the pump may be used to pump diverse materials including acids, alkali, solvents, toxic, and sterile liquids.

Commercially available peristaltic pumptubes are generally uniformly cylindrical, flexible tubes with a uniform wall thickness which provide a fast recovery rate of the flattened portion to the normal cross-sectional area. Such pumptubes are normally formed from resilient elastomeric materials such as natural rubber, silicone, polychloroprene, and polyvinyl chloride. Such materials, however, have limited resistance to chemical degradation. Moreover, such materials may leach components (e.g., softening agents and the like) into the fluid being pumped and/or absorb components from the fluid being pumped. Thus, the use of pumps using such pumptubes is generally restricted to liquids having minimal degradation effects.

Fluoroplastic tubing, which has good corrosion resistance, generally has been found to lack resilience and tends to crease in use, thereby limiting the life of such tubing. U.S. Pat. No. 3,875,970 (Apr. 8, 1975) attempted to overcome this problem by providing a pumptube having a thin inner tubular portion of a corrosion resistant material (such as polytetrafluoroethylene) and a thicker outer tubular portion of a resilient elastomeric material (such as silicone, polychloroprene, flexible polyvinyl chloride, natural or synthetic rubber). The overall pumptube remained flexible. Although the design of this pumptube reportably extended the life of the tubing, it has not been as successful as desired and its use in commercially available peristaltic pumps appears to be very limited.

In addition, a variety of pumptubes incorporating various geometric configurations, including multiple layered tubes, have been used in peristaltic pumps. U.S. Pat. No. 3,105,447 (Oct. 1, 1963) used a double layered pumptube where both the inner and outer tubes consisted of rubber or an elastomer. The pumptube design allowed a lubricant to be pumped through the space formed between the inner and outer tubes. German Patent 3,322,843 A1 (published Jan. 3, 1985) also provided a double layered pumptube with a particularly soft and elastic inner layer and an impermeable outer layer. The inner layer could be formed of silicone, natural rubber, soft polyvinyl chloride, polyurethane, or fluoroelastomer; the outer layer could be formed of polyvinyl chloride, polyurethane, fluoroelastomer, and certain polyethylenes. The pumptube was flexible and maintained a circular cross-section in the uncompressed state. European Patent Publication 0,470,33 A1 (published Feb. 12, 1992) provided a flexible pumptube with an elastic reinforcing member or members disposed therein to reduce fatigue failure upon repeated compression and recovery of the tubing. U.S. Pat. No. 5,067,879 (Nov. 26, 1991) provided a flexible, single- or multi-layered pumptube having two longitudinally extending notches or groves in the outer surface. The groves were reported to improve the flexing characteristics of the tubing during compression and recovery. Although providing useful and significant advances in the art, each of these just described pumptubes has significant limitations for use in peristaltic pumps, especially for peristaltic pumps for corrosive and other difficult to handle liquids.

More recently, U.S. Pat. No. 5,482,447 provided a double layer pumptube having a inner tube and an outer tube, both of which were preferably polytetrafluoroethylene (PTFE). Although this pumptube was a significant advance over the prior art, the pumptube, largely because of its tube within a tube design, was more costly and difficult to manufacture than desired. Additionally, the pumptube's useful lifetime was not as high as desired when operated against a significant back-pressure.

The present invention provides an improved peristaltic pump and an improved pumptube. Using the peristaltic pump of this invention, a single shaped tube of rigid fluoroplastic material (preferably PTFE) can be used. Thus, many of the advantages obtained in the double layered PTFE pumptubes of U.S. Pat. No. 5,482,447 can be obtained using a significantly simplified pumptube (i.e., single tube construction) as provided herein. The pumptube and peristaltic pump of the present invention are especially adapted for use in systems which develop, or can develop, high back- or counter-pressures. Using the present system, peristaltic pumps can operate continuously to pump liquid against a counter-pressure of at least 4 bar at a flow rate of at least 4 liters per minute (LPM).

SUMMARY OF THE INVENTION

The present invention relates to an improved peristaltic pump using a pumptube comprising. a single tube of relatively rigid and hard fluoroplastic material, preferably relatively rigid and hard polytetrafluoroethylene (PTFE), and a roller strap located between the pressure rollers of the peristaltic pump and the pumptube. The roller strap is an inelastic material such as, for example, a polyester, an aromatic polyamide, or the like. Preferably, the roller strap is an aromatic polyamide because of its reduced tendency to form a "hammock" during operation. One especially preferred aromatic polyamide is KEVLAR™ (DuPont). A KEVLAR™ strap coated with polychloroprene on both flattened sides is even more preferred; one especially preferred strap is a 1 mm thick KEVELAR™ strap coated with 0.2 mm of polychloroprene on both flattened sides. The combination of the pumptube and the roller strap allows for improved performance, especially with regard to pumptube lifetime, when operating at relatively high back- or counter-pressure. The present pumptube and peristaltic pump can also be used when such back-pressures are not generated or are not likely to occur.

The pumping section of the pumptube is preformed or shaped into a flattened, oval-like shape (e.g., a flattened U-shape as shown in FIG. 2) which approximately conforms to the occlusion bed or pumptube passageway in the peristaltic pump. The pressure rollers contact the strap, rather than the pumptube itself, and thereby compress the flattened side of the pumptube and effect the transport or pumping of the fluid. The pressure rollers do not directly contact the pumptube since they are separated from the pressure rollers by the roller strap. The inner surface of the flattened fluid passageway is required to move only a relatively short distance when compressed by the pressure rollers. Moreover, the flatten portion of the pumptube is contained on its outer side by the pumptube passageway and on its inner side by the strap. The movement of the pumptube during compression is thus limited. Moreover, the strap prevents excessive expansion of the pumptube, especially in the roll-off section, when operated against a high back- or counter-pressure. Thus, the placement of the strap between the rollers and the pumping section of the pumptube prevents excessive expansion of the pumping section between the rollers themselves and between the last roller and the outlet end, especially when exposed to a significant back or counter pressure. Preferably, the strap rests on guide cams on both the roll-on and roll-off portions of the pump to further limit expansion of the pumptube in the roll-on and/or roll-off portions. Thus, the materials forming the pumptube remain within their elastic fatigue limits, even when operated against high back-or counter-pressure, thereby significantly reducing fatigue failure and significantly increasing the lifetime of the pumptube. The pumptube systems and peristaltic pumps of this invention are especially adapted for situations where the back- or counter-pressure may vary over time. The pumptube systems and peristaltic pumps of this invention can be used for pumping and transporting corrosive, viscous, sensitive, biological, and/or high pressure fluids at high flowrates and against significant back- or counter-pressure.

The present invention provides a peristaltic pump for transporting fluids, said peristaltic pump comprising (a) a pump housing containing a pumptube passageway;

(b) a pumptube to fit within the pumptube passageway, the pumptube having inlet and outlet ends extending outside the pump housing, a pumping section contained within the pumptube passageway, and a fluid passageway extending through the pumptube from the inlet end to the outlet end;

(c) a plurality of pressure rollers rotatably mounted within the housing, whereby each roller in turn compresses the pumping section of the pumptube contained within the pumptube passageway so as to transport fluid from the inlet end to the outlet end of the pumptube;

(d) a guide cam attached to the pump housing to support the pumping section of the pumptube adjacent to the outlet end; and (e) a strap mounted between the plurality of pressure rollers and the pumping section of the pumptube and between the guide cams and the ends of the pumping section of the pumptube so that the pressure rollers are able to compress the pumping section without directly contacting the pumping section;

wherein at least the pumping section of the pumptube comprises a single rigid fluoroplastic tubing preformed to fit within the pumptube passageway such that the pumptube within the pumping section is flattened into an oval-like shape with an oval-shaped fluid passageway such that the pressure rollers compress the pumping section of the pumptube essentially along the flattened side of the oval-like shape without contacting the pumping section. Preferably, the pump housing also has a guide cam to support the pumping section of the pumptube adjacent to the inlet end.

The present invention also provides a peristaltic pump for transporting fluids, said peristaltic pump comprising (a) a pump housing containing a pumptube passageway;

(b) a pumptube having inlet and outlet ends extending outside the pump housing, a pumping section contained within the pumptube passageway, and a fluid passageway extending through the pumptube from the inlet end to the outlet end;

(c) a plurality of pressure rollers rotatably mounted within the housing, whereby each roller in turn compresses the pumping section of the pumptube contained within the pumptube passageway so as to transport fluid from the inlet end to the outlet end of the pumptube; and (d) a strap mounted between the plurality of pressure rollers and the pumping section of the pumptube so that the pressure rollers are able to compress the pumping section without contacting the pumping section;

wherein at least the pumping section of the pumptube comprises a single rigid fluoroplastic tubing preformed to fit within the pumptube passageway such that the pumptube within the pumping section is flattened into an oval-like shape with an oval-shaped fluid passageway such that the pressure rollers compress the pumping section of the pumptube essentially along the flattened side of the oval-like shape without contacting the pumping section. Preferably, guide cams are attached to the pump housing to provide support to the strap near and/or at end of the roll-on and roll-off sections of the peristaltic pump.

The present invention also provides a pumptube system comprising a pumptube and a roller strap, which system is suitable for use in a peristaltic pump having a pumptube passageway and a plurality of pressure rollers for compressing the pumptube whereby a fluid can be transferred, wherein the pumptube comprises (a) inlet and outlet ends;

(b) a pumping section located between the inlet and outlet ends; and (c) a fluid passageway extending through the pumptube from the inlet end to the outlet end;

wherein at least the pumping section of the pumptube comprises a single rigid fluoroplastic tubing, wherein the pumptube is preformed to fit within the pumptube passageway such that the pumptube within the pumping section is flattened into an oval-like shape with an oval-like fluid passageway such that the pressure rollers compress the pumping section of the pumptube essentially along the flattened side of the oval-like shape;

and wherein the roller strap comprises an inelastic material located between the pressure rollers and the pumping section of the pumptube so that the pressure rollers do not contact the pumping section of the pumptube when the pumping section is compressed.

The present invention also provides a method of preparing a pumptube suitable for use in a peristaltic pump having a pumptube passageway, wherein the pumptube has a flattened, oval-like shaped pumping section with an oval-like fluid passageway, a plurality of pressure rollers, an inelastic strap located between the pressure rollers and the pumptube, wherein the pressure rollers, through pressure transferred though the strap, compress the pumptube via the strap without directly contacting the pumptube, whereby a fluid can be transferred, said method comprising (a) forming a length of a rigid fluoroplastic tubing having a fluid passageway extending throughout the length of the rigid fluoroplastic tubing;

(b) placing a central portion of the length of rigid fluoroplastic tubing in a clamping fixture capable of compressing the central portion;

(c) compressing the central portion of the rigid fluoroplastic tubing at or near room temperature using the clamping fixture to form a fully compressed and flattened section in the central portion;

(d) allowing the fully compressed and flattened section to expand to form the flattened, oval-like shaped pumping section with the oval-like fluid passageway therein;

(e) heating at least the pumping section of the rigid fluoroplastic tubing to a temperature sufficient to increase the malleability of the rigid fluoroplastic tubing;

(f) placing the heated rigid fluoroplastic tubing in a molding fixture capable of molding the pumptube into a shape to fit within the pumptube passageway;

(g) molding the pumptube into the shape to fit within the pumptube passageway without obstructing the oval-like fluid passageway; and (h) allowing the pumptube to cool to or near ambient temperature within the molding fixture;

whereby the pumptube fitting within the pumptube passageway of the peristaltic pump is obtained. Preferably a core is placed within the fluid passageway during the molding step to help maintain the desired cross-section within the oval-like fluid passageway and to prevent obstructing the oval-like fluid passageway. Alternatively, gas under pressure can be pumped through the fluid passageway during the molding step to achieve the same effect. Of course, such a core would be placed within the fluid passageway before step (e) and then removed after step (h).

These and other embodiments and advantages of the present invention will be apparent from a consideration of the present specification and drawing.

DESCRIPTION OF FIGURES

FIG. 6A illustrates a fixture for forming the pumptube of FIG. 2 in a U-shaped to fit the pumptube passageway of FIGS. 1 and/or 4. FIG. 6B provides a side view of the pumptube and fixture along section line CC.

DETAILED DESCRIPTION OF THE INVENTION

This invention relates to improved peristaltic pumps and to improved pumptube systems for use therein. The improved pumptube system consists of a single rigid fluoroplastic tube and a corresponding roller strap. The pumping section of the pumptube is formed or shaped into a flattened, oval-shaped form with an oval-shaped fluid passageway. The pumping section, although compressed by the pressure rollers during operation of the peristaltic pump, is not in contact with the pressure rollers. The roller strap is placed between the pressure rollers and the pumping section. Pumping pressure is applied to the roller strap by the pressure rollers and is then transmitted to the pumping section of the pumptube. The indirect transmission of pressure compresses the pumptube and pumps the liquid. The use of the roller strap allows the length of pumping section of the pumptube to be essentially, and closely, confined or contained within a pumptube cavity defined by the pumptube passageway (i.e., the occlusion bed) and the roller strap. By confining the pumping section within the pumptube cavity, the overall movement of the pumptube during compression and decompression is significantly limited. More specifically, the exit portion or roll-off section of the pumping section cannot significantly expand when exposed to back- or counter-pressure downstream from the pump. Thus, the present pumptube is especially useful in conditions where a significant back-or counter-pressure is encountered or may develop (e.g., a variable restriction downstream such as a filter which can become partially clogged).

Figure 1B:
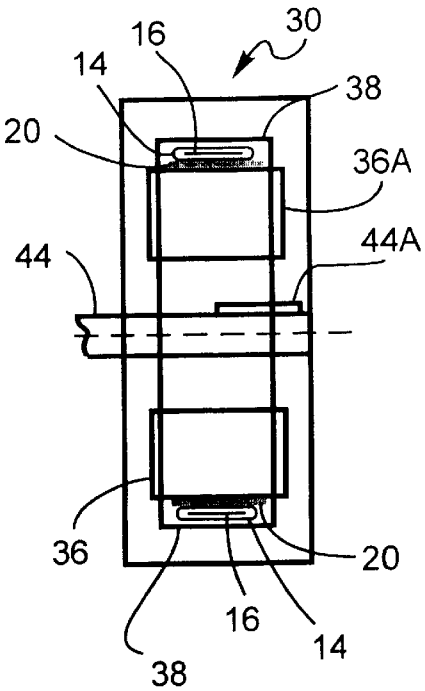
FIG. 1B provides a side view of the peristaltic pump of FIG. 1A along section line BB. For clarity, the roller strap 20 in FIGS. 1A and 1B are shown in a light gray color.
Figure 1A:
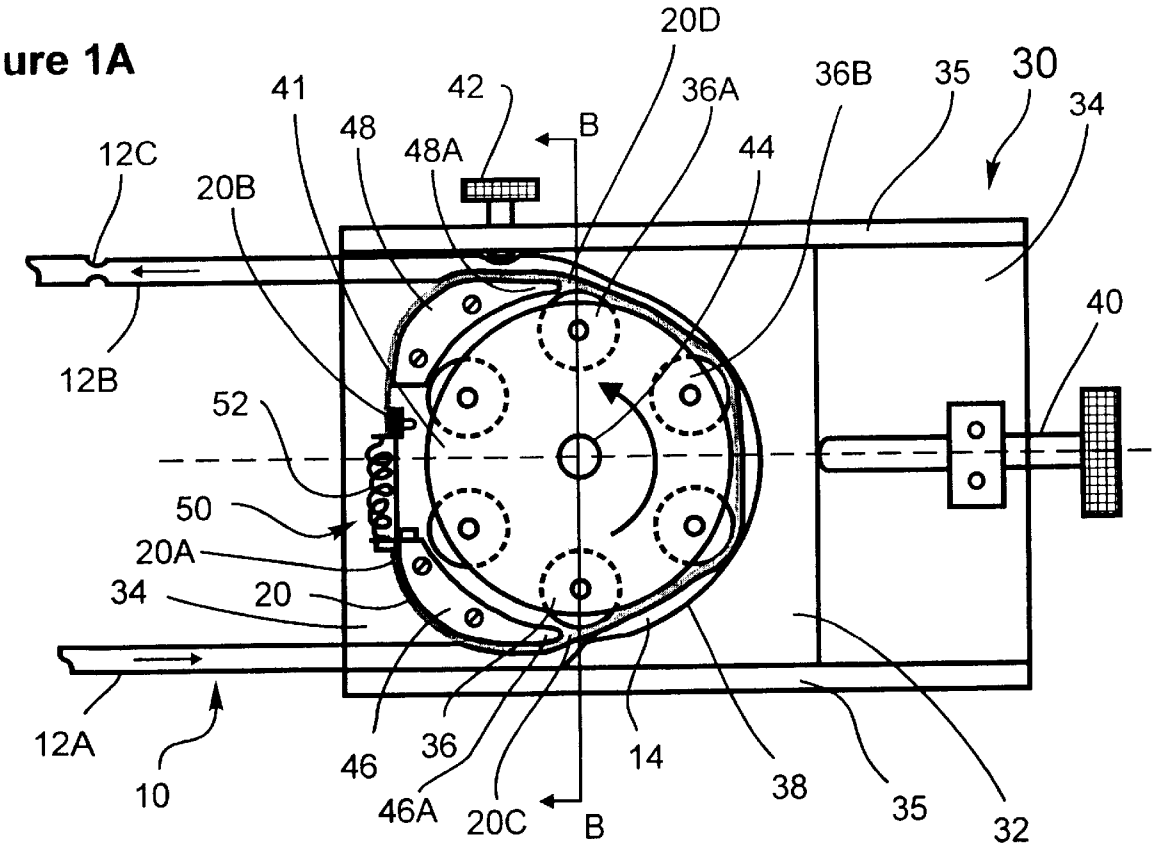
FIG. 1A is a schematic view of a peristaltic pump with a pumptube 10 as provided by the present invention.
Figure 2A:
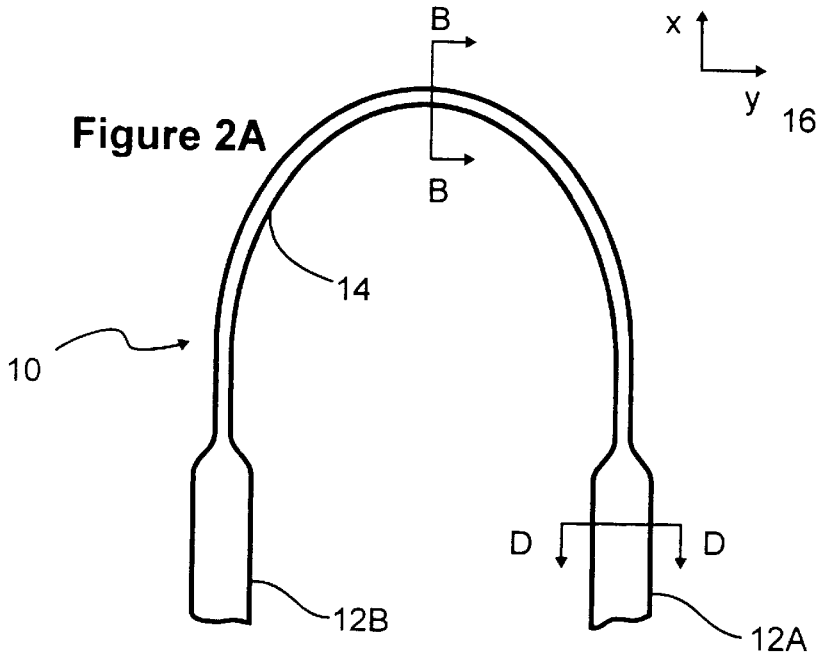
FIG. 2A illustrates a formed pumptube of the present invention suitable for use in the peristaltic pumps of FIGS. 1 and 4.
Figure 2B:
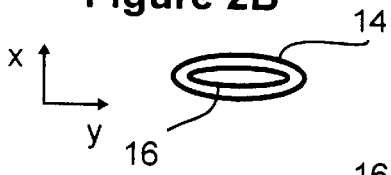
FIGS. 2B and 2C provide cross-sectional views of the pumping section through line BB during the non-compressed state (2B) and the compressed state (2C).
Figure 2C:
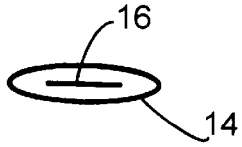

A pumptube 10 is shown in combination with one embodiment of an assembled peristaltic pump 30 and a roller strap 20 in FIG. 1A. The pumptube 10 is separately shown in FIG. 2A; the roller strap is separately shown in FIG. 3A. The formed pumptube 10 is a single, rigid fluoroplastic tube having an inlet portion 12A, an outlet portion 12B, and a flattened pumping section 14. The flattened pumping section 14 has flattened fluid passageway 16. The inlet portion end 12A is attached to a fluid container or source by an appropriate connector (not shown) and the outlet end 12B is attached to a fluid container or receiver by an appropriate connector (also not shown) so as to move fluid from the fluid source to the fluid receiver via pumptube 10. The "restriction" at point 12C on the outlet side 12B of the pumptube represents a possible source of back-pressure.

As one of ordinary skill in the art will understand, the outlet and inlet ends in pumptube 10 are essentially of the same configuration and cross-sectional area (see FIG. 2); they can, if desired, be of different configurations and/or cross-sectional areas. The pumping section 14 of pumptube 10 is flattened and shaped to conform to the pumptube passageway of the particular peristaltic pump used (one such pumphead is shown in FIG. 1). The pumptube 10 in FIGS. 1 and 2 and its flattened pump section 14 essentially forms a portion of a circular section (i.e., U-shaped; see FIG. 2) to fit and conform to the pumptube passageway (formed by the occlusion bed 38 and roller strap 20) of the peristaltic pump in FIG. 1. Other shapes can be used so long as they conform to the pumptube passageway of the pump and have flattened and oval-like shaped pumping sections 14 as described herein. Generally abrupt changes in direction (i.e., sharp or tight bends and the like) should be avoided in the pumptubes of this invention. Such sharp bends could significantly reduce or restrict the cross-sectional area of the fluid passageway (perhaps even closing it completely), thereby adversely affecting the operational characteristics of the pumptube and peristaltic pump.

As shown in FIG. 1, the assembled peristaltic pump 30 is formed of the following major components: housing 34 (including guide bars 35, adjustment assembly 40, and thumb screw 42), a slidable member 32, roller assembly 41, and strap assembly 50 (including roller strap 20, guide cams 46 and 48, and spring assembly 52). The circular portion 38 of slidable member 32 forms the occlusion bed to receive the flattened section 14 of pumptube 10. The flattened portion 14 of pumptube 10 fits within the pumptube passageway formed by occlusion bed 38 and roller strap 20; generally the flattened portion 14 of the pumptube 10 extends from the leading edge 46A of guide cam 46, through the occlusion bed 38, to the trailing edge 48A of guide cam 48 (see FIG. 1A). The roller assembly 41 consists of a plurality of rollers 36 and pump drive shaft 44. As shown in FIG. 1A, the drive shaft 44 allows rotation of the roller assembly in a counter clockwise direction (as indicated by the arrow on the assembly). If desired, the pump could be made reversible whereby the rotation could be in the opposite direction. Riding the strap 20 over the guide cams 46 and 48, regardless of the flow direction, would allow the pumptube to operate at high back-pressures while still preventing excessive tube expansion at the output end.

The roller assembly 41 is locked or held in place on drive shaft 44 using locking key 44A or other suitable locking devices. Strap 20 is placed between the rollers 36 and the pumptube 10. Thus, the spinning rollers 36 never physically or directly contact the pumptube 10. The pumptube 10 is compressed by pressure transmitted through the roller strap 20 from the pressure rollers. The roller assembly 41 shown in FIG. 1A has six pressure rollers 20. Although fewer pressure rollers can be used, it is generally preferred that five or more pressure rollers be used in order to reduce the distance between any two adjacent rollers and, thus, the distance in which the roller strap 20 is unsupported. More preferably, the roller assembly 41 has five to eight pressure rollers with five or six pressure rollers being most preferred.

The strap biasing assembly 50 consists of the roller strap 20, the two guide cams 46 and 48, and spring or biasing element 52. As shown in FIG. 1B, the width of the roller strap 20 is preferably about the same width as the pressure rollers 36. The roller strap 20 has a fixed end 20A and a floating end 20B. As shown in FIG. 1A, the fixed end 20A is attached to guide cam 46. From its fixed position on guide cam 46, the roller strap 20 loops around the outer surface of guide cam 46, the outer surfaces of the pressure rollers 36, and the outer surface of guide cam 48. The floating end 20B is then attached to fixed end 20A (or to a portion of housing 32 or guide cam 46) via biasing element 52. Preferably, the biasing element 52 is a spring. The biasing element 52 should be sufficient to maintain the roller strap 20 tightly against the outer surface of the pressure rollers 36 and guide cams 46 and 48 during operation. Preferably the biasing element 52 is adjustable so that the pressure on the roller strap 20 can be adjusted. Generally, the strap is stretched by a pulling force equivalent to about 25 to about 30 kg.

Figure 3B:
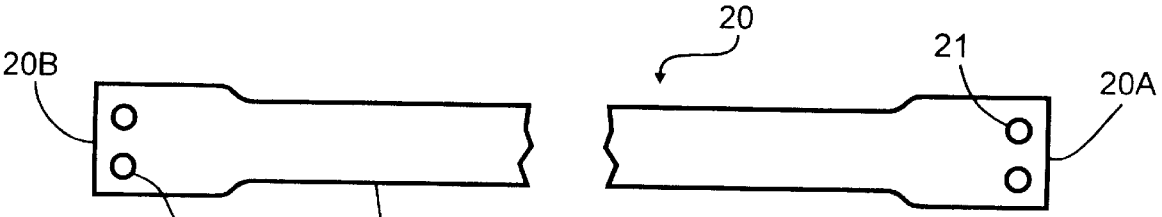
FIG. 3B illustrates a "slim-waisted" roller strap (in side view) which can be used to prevent or reduce the likelihood of "strap-hammock" formation during operation of the peristaltic pump.
Figure 3C:
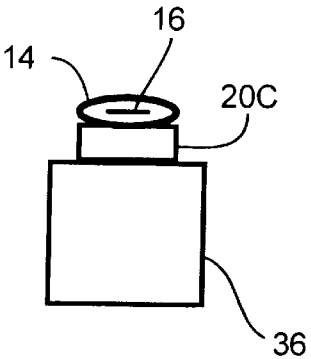
FIG. 3C illustrates the relationship of the "slim-waisted" strap, the flattened portion of a pumptube, and a roller during operation.
Figure 3D:
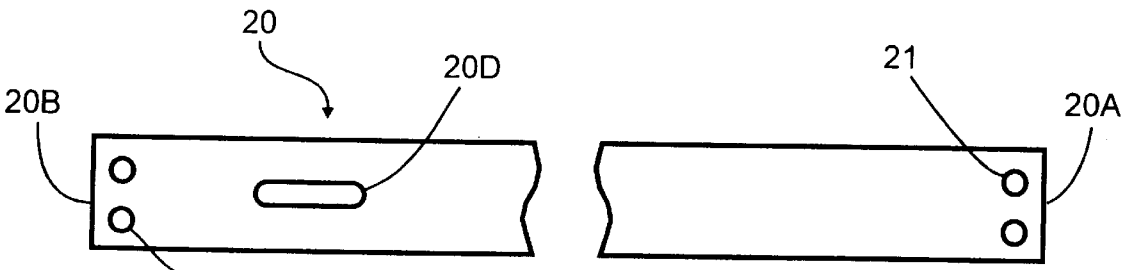
FIG. 3D illustrates a roller strap (in side view) having a "hole" or slot to provide a controlled backleak from the outlet to the pumping section during operation of the peristaltic pump; the amount of backleak will be proportional to the back-pressure, the number of holes, and the hole sizes.
Figure 3A:
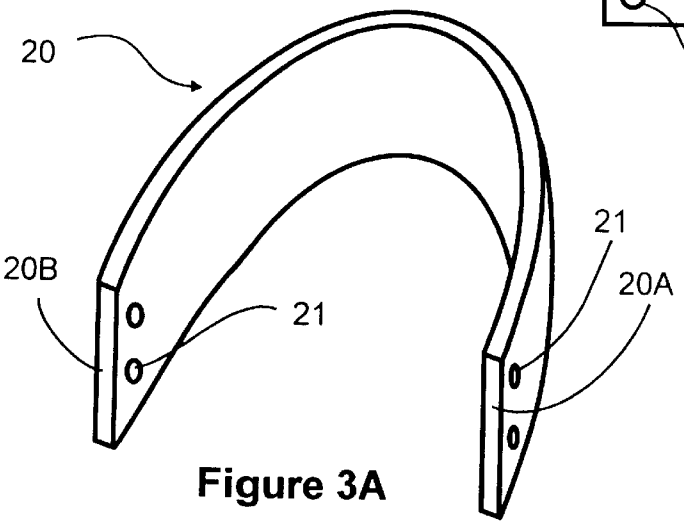
FIG. 3A illustrates a roller strap (in perspective view) used to cover the pressure rollers in the peristaltic pump of FIG. 1.

The strap for use in the peristaltic pump of FIG. 1 is shown separately in FIG. 3A. At or near both ends (20A and 20B) of the strap 20 are mounting holes 21 for attaching to the guide cam 46 (adjacent to the inlet portion 12A of the pumptube 10) and to the biasing assembly 50 (adjacent to the outlet portion 12B). Other means of attachment can, of course, be used, including, for example, plastic or metal brackets or connecters attached to the ends of the strap, brackets or connectors formed of the same material as the strap and, if desired, integral with the strap. As those skilled in the art will realize, the fixed end 20A should preferably be located adjacent to the inlet 12A and the floating end 20B should be located adjacent to the outlet 12B of the pumptube since rotation of the roller assembly 41 will push or pull the strap in the counter-clockwise same direction (see FIG. 1).

A "slim-waisted" roller strap 20, which can be used to reduce "hammock" formation, is shown in FIG. 3B. The portion 20C is reduced in size relative to ends 20A and 20B. As shown in FIG. 3C, this narrowed portion 20C (shown between the roller 36 and the fattened portion 14 of the pumptube) will have a reduced tendency to distort or form a hammock during operation since the strap 20C is fully contacted with both the roller 36 and the pumptube portion 14 across essentially its entire width during operation. Of course, a similar effect could be obtained by simply making the width of the entire strap (i.e., from one end to the other) of a suitable size.

The two guide cams 46 and 48 are situated in the housing 34 so that the portions and length of the roller strap 20 which are unsupported at the roll-on and roll-off positions can be minimized or even eliminated. By fully supporting the roller strap 20, excessive pumptube expansion at output back-pressure is significantly reduced or eliminated, thereby significantly increasing pumptube lifetimes. If desired, the two guide cams 46 and 48 can be adjustable within the housing 34. Thus, the leading edge 46A of guide cam 46 could be finely adjusted to minimize the distance from the leading edge 46A to the first contact point of the roller strap 20 with the first pressure roller (point 20C in FIG. 1A). Likewise, the trailing edge 48A of guide cam 48 could be adjusted to minimize the distance from the trailing edge 48A to the last contact point of the roller strap 20 with the pressure roller 36A (point 20D in FIG. 1A).

In operation, the pumptube 10 is placed in the peristaltic pump 30 in FIG. 1 by opening the adjustment assembly 40 and moving slidable member 32 back towards the adjustment assembly 40. This allows the pumptube 10 to be inserted into the peristaltic pump. Once the pumptube 10 is in place (between the roller strap 20 and the occlusion bed 38 as illustrated in FIG. 1A), the slidable member 32 is moved back into the position shown in FIG. 1 and held securely in place using adjustment assembly 40. When properly adjusted, the flattened portion 14 is fitted snugly within the pumptube passageway formed by the roller strap 20 and occlusion bed 38. Thumb screw 42 can be tightened against the pumptube to prevent excessive creeping or movement of the pumptube during operation (i.e., prevent or reduce the tendency of the pumptube to migrate counter-clockwise during operation).

The drive shaft 44 is used to rotate the roller assembly 41 as shown in FIG. 1. As the roller assembly 41 rotates, the individual rollers 36 compress the flattened portion 14 of the pumptube 10 by exerting pressure through the roller strap 20. The notations in FIG. 1 for pressure rollers 36A and 36B are intended to refer to the general location of any of the pressure rollers 36 as they pass through the locations indicated by 36A and 36B in FIG. 1. As roller 36A passes out of contact with strap 20 (and indirectly the flattened portion 14), the portion of the fluid passageway 16 between rollers 36A and 36B (i.e., the roll-off section) will be at the pressure $P_o$ of the outlet end 12B of the pumptube 10. The remainder of the fluid passageway 16 (i.e., from location of roller 36B back to the inlet end 12A will be at the inlet pressure $P_i$ (normally around 1 atmosphere). That is, the pressure within the pumptube from roll-on up through roller 36B, assuming no back leakage from the section between rollers 36A and 361, will generally remain at, or close, to $P_i$. Thus, in normal operation, the fluid passageway 16 between positions 36A and 36B will be subjected to repeated cycling between $P_i$ and $P_o$. If not contained within, and restrained by strap 20, the pumptube in this area would tend to continuously flex and expand. Under such conditions, pumptubes constructed of relatively rigid fluoropolymers would have a very short lifetime (on the order of minutes) due to stress failure from the continuous exposure to the pressure differential. Using strap 20 of this invention prevents excessive flexing or expanding of the fluid passageway 16 as it is continuously exposed to the pressure differential. By preventing or substantially reducing movement (i.e., expansion due to pressure $P_o$ and then returning to the original cross section at $P_i$) of the pumptube in the region between rollers 36A and 36B, the lifetime of the pumptube can be significantly increased. Thus, for example, pumptubes of this invention have been used in excess of about 20 hours when operated at a back-pressure ($P_o$) of about 4 bar and a pumping rate of about 4 liters per minute. Similar pumptubes used in conventional peristaltic pumps (i.e., without the roller strap 20 and biasing assembly 50) operated under these same conditions would be expected to fail within a matter of minutes (generally within 60 minutes or less). Indeed, such pumptubes in a conventional peristaltic pump would have an essentially zero useful lifetime.

As those skilled in the art will realize, high pressure peaks (e.g., about 6 to about 8 bar) may occur at the output end of the fluid passageway. If these high pressure peaks are sufficiently high, pumptube lifetime may be reduced. Such high pressure peaks can be reduced or attenuated by providing controlled backleaks at the output end of the fluid passageway. One method would be to tighten the occlusion screw 40 to just completely close or occlude the pumptube passageway 14 under operating conditions (e.g., 4 bar and 4 liters/minute). Higher backpressures (i.e., greater than the pressure under which the adjustment was made) would automatically open a minor backleak or "hole" past the roller exposed to the higher backpressure, thereby reducing excess pressure. Once the backpressure is reduced to the adjusted value, this "hole" would automatically close. Another method to achieve such controlled backleaks is to increase the outer radius of the occlusion bed near the output end so that the last roller 36A does not fully compress or occlude the pumping section 14 near the output end. Alternatively, such controlled backleaks can be obtained by providing one or more suitably placed holes in the strap at or just before roller roll off at the output end. Such holes prevent the roller/strap combination from completely occluding the fluid passageway at that point, thereby providing the controlled backleak. FIG. 3D illustrates a strap with one such hole 20D. Although other shaped holes can be used, an elongated hole or slot 20D would generally be preferred since it is easier to place such a slot over the roller roll off at the output end.

Figure 4:
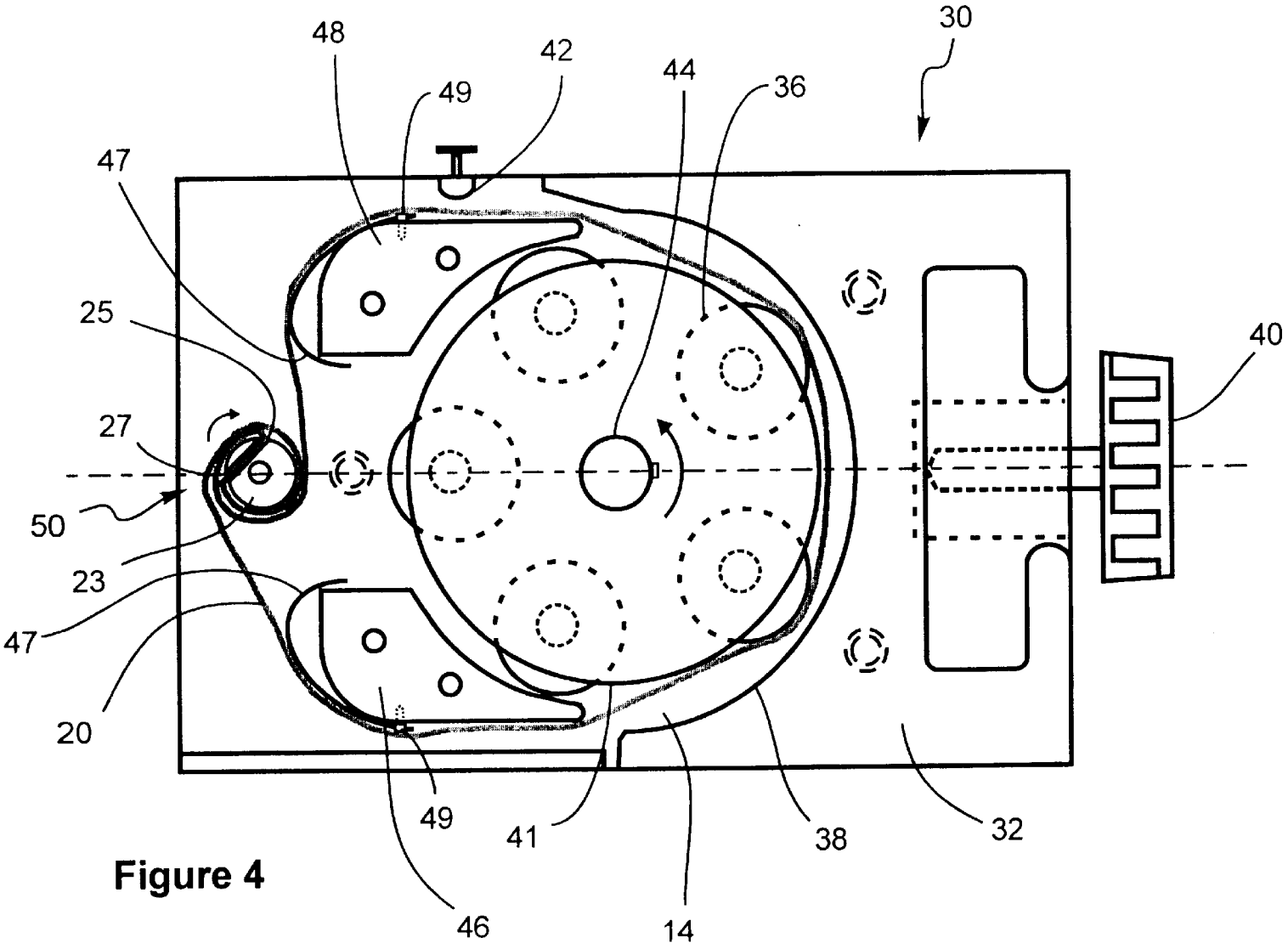
FIG. 4 is a schematic view of another embodiment of the peristaltic pump of this invention using a continuous roller strap. The modified guide cams having leaf spring biasing elements of FIG. 1C are also shown. For clarity, the roller strap 20 is illustrated using a light gray color and the pumptube is omitted.

Another embodiment of the peristaltic pump of this invention using a continuous, preferably seamless, loop as the roller strap 20 is shown in FIG. 4. (Similar elements in FIGS. 1 and 4 are similarly numbered and act in similar ways. Thus, only the features directed to the continuous loop in FIG. 4 need be discussed. The pumptube has been omitted from FIG. 4.) The roller strap 20 in the peristaltic pump of FIG. 4 is a continuous loop which encircles guide cams 46 and 48 as well as the individual rollers 36 within the roller assembly 41. The biasing assembly 50 of this embodiment comprises a take-up mechanism 23 having a slot 25 for receiving a folded-over portion or end 27 of the continuous roller strap 20. Once the folded portion 27 is engaged in the slot 25, the take-up mechanism 23 can be rotated in the direction shown in FIG. 4 to tighten the roller strap 20. Once the roller strap 20 is properly tightened (e.g., a force equivalent to about 25 to about 30 kg), the take-up mechanism 23 can be locked in place using, for example, a locking screw or bolt, a ratchet system, or other conventional systems. Although it is preferred that roller strap 20 in FIG. 4 is a continuous loop, a non-continuous roller strap could also be used by simply inserting both ends of such a roller strap in slot 25 and then tightening the take-up mechanism 23 as described above. Using a continuous loop, especially a continuous and seamless loop, generally allows for a longer lifetime for the roller strap since the strap can be moved so as to allow a new length of the roller strap to contact the pressure rollers. Using this embodiment, of course, the continuous roller strap 20 does not require mounting holes 21 as shown in FIG. 3.

Figure 1C:
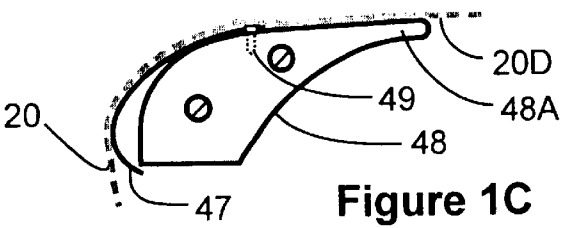
FIG. 1C provides a modified guide cam having a leaf spring. For clarity, the roller strap 20 in FIG. 1C illustrated as discontinuous grayscale line.

FIG. 1C illustrates a modified guide cam 48 having a leaf spring 47 mounted on the guide cam via spring screw 49. In operation, the roller strap would ride upon the leaf spring 47 which would provide a biasing action against the roller strap and help hold it tightly to the rollers. The strength of the leaf spring 47 can be adjusted as needed to maintain proper tension on the roller strap. FIG. 4 illustrates the use of such leaf springs 47 on both guide cams 46 and 48.

FIG. 2 illustrate a pumptube 10 suitable for use in the peristaltic pumps of FIGS. 1 and 4. FIGS. 2B (uncompressed state) and 2C (compressed state) show a cross-section view of the pumping section 14 through line B—B in FIG. 2A; FIG. 2D shows a cross-section view of the inlet 12A through line DD. As shown in FIG. 2B, the uncompressed state of the fluid passageway 16 is flattened and has an oval-like shape. By "oval-shaped" in regard to the pumping section 14 and the fluid passageway 16, it is meant that the shape is generally oval with a relatively smaller or minor diameter parallel to the flattened side (i.e., x-axis) and a relatively larger or major diameter parallel to the y-axis as shown in FIG. 2. The oval-shaped fluid passageway may be in the form of an oval, an ellipse, a football shape, an elongated slit or slot having torpedo-shaped ends, and the like so long as the minor diameter is significantly less than the major diameter. In fact, a football shape or elongated slit having torpedo-shaped ends (as suggested in FIG. 2B) may be preferred because such the narrow ends of the fled passageway 16 should be exposed to less stress when compressed. It is generally preferred that the major diameter of the fluid passageway is at least 3 times, and more preferably at least 5 times, greater than the minor diameter. In operation, pressure rollers will contact the flattened surface and compress the pumping section as shown in FIG. 2B to form the compressed configuration shown in FIG. 2C. As can be seen in FIG. 2C, the fluid passageway 16 has been effectively occluded (i.e., closed) as represented by the straight line 16. Although complete occlusion (as shown in FIG. 2C) is generally preferred, occlusions less than 100 percent can also be employed. Once the pressure roller passes by a given point on pumping section 14, that point of the pumptube returns to the uncompressed state shown in FIG. 2B. The maximum distance the surfaces of the fluid passageway 16 must travel for complete occlusion is the minor diameter. By reducing the distance over which the tube material must travel for occlusion, materials of construction having lower elastic fatigue limits can be employed.

The movement associated with repeated occlusion and recovery (i.e., moving from FIG. 2B to 2C to 2B repeatedly) is well within the elastic fatigue range of rigid and hard fluoroplastic materials, including polytetrafluoroethylene, used in the present pumptubes.

As noted above, the pumptubes of the present invention, in combination with the roller strap 20, limit the movement in the pumping section 14 during occlusion and recovery so as to maintain the materials of construction (i.e., fluoroplastic tubing) within their elastic fatigue limits.

Moreover, the roller strap 20 limits excessive and damaging expansion of the fluid passageway 16 when exposed to pressures higher than atmospheric. This is especially critical in the roll-off portion of the pumptube (i.e., the distal end of the flattened portion of the pumptube which includes the length between pressure rollers 36A and 36B and the length from pressure roller 36A to the end of the flattened portion). The roller strap 20 prevents the distal end of the flattened portion of the pumptube from expanding during the periodic removal of compression that results from the passage of the terminal roller pressure (i.e., during the roll-off phase). The failure associated with fatigue (i.e., cracking and the like) is significantly reduced and delayed, thereby resulting in acceptable pumptubes lifetimes. Generally, a pumptube of the present design using a polytetrafluoroethylene pumptube is expected to have a lifetime of about 20 to about 30 hours or greater when operating under high back-pressure conditions. When used in situations with little or no back-pressure (e.g., inlet and outlet pressure are essentially one atmosphere), lifetimes of up to about several hundred hours or greater are expected.

The pumptube is a relatively rigid and hard fluoroplastic and preferably is selected from the group consisting of perfluoroalkyoxy resin, fluorinated ethylene propylene, polychlorotrifluoroethylene, ethylene-chlorotrifluoroethylene copolymer, ethylene-tetrafluoroethylene copolymer, and polytetrafluoroethylene. The most preferred fluoroplastic for the tube is relatively rigid and hard polytetrafluoroethylene (PTFE). PTFE resin suitable for manufacture of PTFE tubing is available, for example, under the tradenames Algoflon (Ausimont USA Inc., Morristown, N.J.), Teflon (E.l. du Pont de Nemours & Co., Wilmington, Del.), Fluon (ICI Americas Inc., Wilmington, Del.), and Hostaflon (Hoechst Celanese Corp., Sommerville, N.J.). Suitable extruded PTFE tubing is generally available from, for example, Furon Co. (Laguna Niguel, Calif.), Norton Performance Plastics (Wayne, N.J.), Habia, AB (Sweden), and Zeus Industrial Products (Raritan, N.J.).

Generally the pumptube is formed from a relatively rigid and hard fluoroplastic tube, preferably a relatively rigid and hard polytetrafluoroethylene tube, with a Shore D hardness of about 25 to about 80, an outer diameter of about 4 to about 25 mm, an inner diameter of about 2 to about 22 mm, and a wall thickness of about 1 to about 2 mm. More preferably, the pumptube is formed from a relatively rigid and hard polytetrafluoroethylene tube with a Shore D hardness of about 50 to about 65, an outer diameter of about 12 to about 16 mm, an inner diameter of about 10 to about 13 mm, and a wall thickness of about 1 to about 1.5 mm. "Relatively rigid and hard" is intended to describe a pumptube which can still be flexed or bent but tends to return to its original shape, which retains its overall shape and especially the flattened, oval-like shape in the pumping section after use, and which requires significant force to occlude the fluid passageway in the pumping section.

Figure 2D:
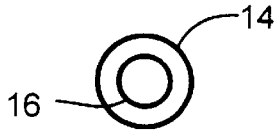
FIG. 2D provide a cross-sectional view through line DD.

Of course, the dimensional ranges given above for the pumptube relates to the tube before forming and shaping the pumping section 14 and to the unshaped portion of the completed pumptube (i.e., 12A and 12B; see also FIG. 2D). The pumptube, including the pumping section 14, is formed and shaped to produce an oval-like or U-shaped pumptube with an oval-like fluid passageway 16 as shown in FIG. 2. The overall shape to the pumptube is designed to fit into the pumptube passageway of the peristaltic pump. FIG. 2 illustrates an overall U-shape which is designed to fit the pumptube passageway of the peristaltic pump of FIG. 1. Of course, other overall shapes can be used so long they are adapted to the specific pumptube passageway in the peristaltic pump. As noted above, it is generally preferred that the major diameter of the fluid passageway in the pumping section is at least 3 times, and more preferably at least 5 times, greater than the minor diameter. Generally the minor diameter of the fluid passageway in the pumping section is in the range of about 0.1 to about 4 mm, and preferably in the range of about 0.15 to about 3 mm. Generally the major diameter of the fluid passageway in the pumping section is in the range of about 0.5 to about 30 mm, and preferably in the range of about 3 to about 20 mm. Generally the outside, cross-sectional dimensions of the pumptube in pumping section (i.e., FIG. 2B) are about 2 to about 18 mm by about 6 to about 40 mm.

One especially preferred pumptube is constructed with a polytetrafluoroethylene tube having an inner diameter of about 6 mm, an outer diameter of about 8 mm, and a wall thickness of about 1 mm. Preferably, the flattened, shaped pumping section of such a pumptube has an outside, cross-sectional dimension of about 5 mm by about 10 mm and an oval-shaped fluid passageway of about 1 mm (minor diameter) by about 6 mm (major diameter). A second especially preferred pumptube is constructed from a polytetrafluoroethylene tube having an inner diameter of about 16 mm, an outer diameter of about 19 mm, and a wall thickness of about 1.5 mm. Preferably, the flattened, shaped pumping section of such a pumptube has an outside, cross-sectional dimension of about 14 mm by about 24 mm and an oval-shaped fluid passageway of about 2 mm (minor diameter) by about 20 mm (major diameter).

Compressing the flattened, oval-shaped pumping section 14 (i.e., moving from the uncompressed state of FIG. 2B to the compressed state of FIG. 2C) generally requires much higher compression pressures than conventional pumptubes. For example, compression of a representative pumptube of FIG. 1 having the dimensions described in the preceding paragraph will generally require a force of about 100 to about 600 pounds to fully occlude an empty fluid passageway. Based on an estimate of the contact area between the pumptube and the pressure roller, a force of about 100 pounds for full occlusion is estimated to be equivalent to about 1000 pounds per square inch. For comparison purposes, only a force of about 5 to about 20 pounds (equivalent to about 50 to about 200 pounds per square inch) would be required to fully occlude the fluid passageway of an empty conventional flexible pumptube of comparable dimensions.

The pumptubes of the present invention can generally be used in peristaltic pumps of conventional design so long as the pump head components are modified to accommodate and accept the present pumptubes and roller strap. The shaped and flattened portion of the pumptube must, of course, conform to the pumptube passageway in the peristaltic pump. The rotor and pressure rollers in the peristaltic pump must accommodate, or be modified to accommodate, the higher pressures generally required for the rigid pumptubes of this invention. In addition, the peristaltic pump preferably is modified or designed to easily accept the pumptube. Due to the rigid nature of the present pumptubes, they cannot be easily threaded through the pumptube passageway as can the flexible pumptubes of the prior art. Rather, the peristaltic pump preferably is designed to allow the rigid pumptubes to be easily inserted and mounted into the pumptube passageway and then easily engaged in the pumping position. In FIG. 1, the retraction or movement of slidable member 32 towards the adjustment assembly 40 allows the pumptube to be easily inserted in the peristaltic pump.

Peristaltic pumps having designs other those shown in FIGS. 1 and 4 can, of course, be used with the pumptubes of this invention. The pumptubes used, however, should be shaped to fit the specific pumptube passageway of the particular peristaltic pump and could, therefore, be of very different overall shapes and configurations than the U-shaped pumptube shown in FIG. 2. The cross sectional areas in the non-pumping and pumping sections of the pumptube would, however, be similar to those shown in FIG. 2. In addition, and preferably, the peristaltic pump should allow, or provide for, the pumptube to be easily inserted and removed. In addition to the peristaltic pumps shown in FIGS. 1 and 4, a pump design as shown in, for example, U.S. Pat. No. 5,082,429 (Jan. 21, 1992), which is hereby incorporated by reference, could be used with the appropriately-shaped pumptubes and roller straps of this invention. The pump design can incorporate a caming or locking mechanism to facilitate opening and closing of the pump and, therefore, insertion and removal of the pumptube. Although not preferred, pump designs which require the pump housing to be disassembled to insert and remove the pumptube can be used if desired. By modifying the overall shape of the pumptube and providing for higher occlusion pressures, peristaltic pumps having other designs and/or configurations can employ the rigid, relatively non-flexible, shaped pumptubes and roller straps of this invention.

Figure 5A:
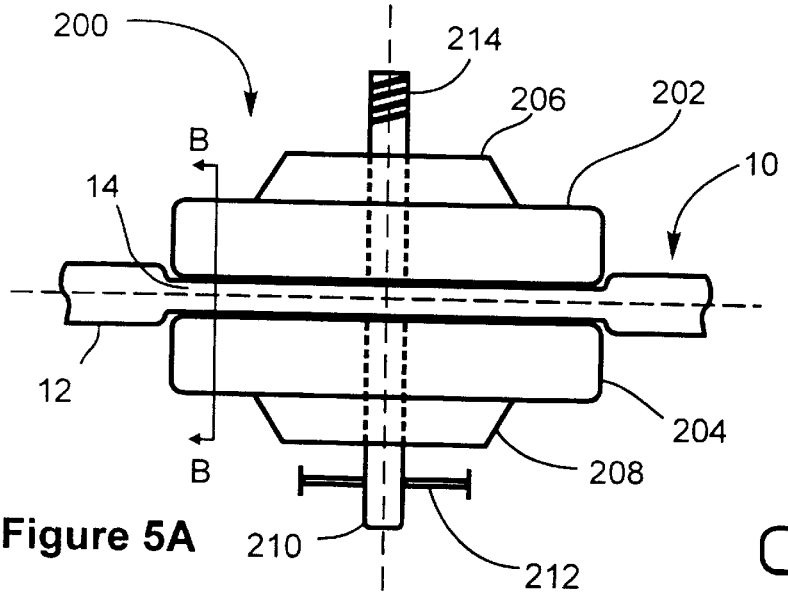
FIG. 5A illustrates a fixture for pre-forming the flattened pumping section of the pumptube.

As detailed above, the rigid pumptube of the present invention are shaped to conform to, and fit within, the pumptube passageway so that the pressure rollers contact the roller strap and then compress the flattened side of the flattened, oval-like shape forming the pumping section. The process of preparing the pumptubes of this invention preferably involves two stages using the fixtures illustrated in FIGS. 5 and 6. Using the fixture illustrated in FIG. 5A, the flattened portion or pumping section is formed first. Generally, a rigid tube or blank of the desired fluoroplastic material is inserted into vice 200 (in the open position). The vice 200 consists of upper and lower clamping surfaces 202 and 204, upper and lower jaw members 206 and 208, and clamping members 210 (shaft with threads 214 at the distal end) and 212 (rotatable handle). The vice is then tightened to form the flattened portion 14 having fluid passageway 16. The width of the clamping surfaces should be sufficient to provide the desired length for the pumping section. Preferably, the flattened portion is formed at or near ambient temperature. Preferably, the upper and lower clamping surfaces 202 and 204 are formed from relatively soft and compressible materials (e.g., wood, and more preferably a soft wood such as pine) to avoid damaging the outer surfaces of the pumptube as the flattened section is formed. Of course, as those skilled in the art will realize, other vices or similar fixtures could be used.

Generally, the flattened section is formed by simply compressing the section of the tube within the vice. Preferably, the pumping section is essentially fully compressed with fixture 200; full or essentially full compression can be determined by simply blowing into the tube. Once essentially fully compressed, the tube is held in the compressed state for a relatively short time (i.e., about 1 to about 10 minutes) and then released from the vice. After letting the tube expand or relax after the vice treatment (i.e., to achieve the cross-section shown in FIG. 2B), the tube can then be further shaped to provide the desired overall shape to fit the peristaltic pump; in the case of the peristaltic pump shown in FIG. 1, the desired overall shape is a U-shaped configuration.

To form the desired overall shape for the pumptube, the blank with the flattened pumping section (obtained using the fixture shown in FIG. 5 or similar tool) is heated to increase the malleability of the fluoroplastic material to be able to form it in the desired shape. Generally a temperature of about 75 to about 100° C. should be sufficient. Of course, as one skilled in the art will realize, the optimal temperature to which the blank should be heated will depend on a number of factors (e.g., overall size of tube, thickness of tube, length of pumping section, overall shape desired, and the like) and can best be determined experimentally for a given configuration. Once heated, the blank is immediately (i.e., generally within a minute or less) placed in an appropriate shaping fixture. The shaping fixture should approximate the shape of the pumptube passageway in the peristaltic pump which is to be used. The fixture 300 shown in FIG. 6 is designed to provide pumptubes suitable for use in the peristaltic pumps shown in FIGS. 1 and 4. Of course, different peristaltic pump designs will necessitate different fixture designs. Additionally, the overall shape and construction of the fixtures are not critical so long as they can shape and form the pumping section into the desired flattened and oval-like shape and the overall pumptube into the approximate configuration of the pumptube passageway of the peristaltic pump to be used.

The fixture 300 shown in FIGS. 6A and 6B consists of a male member 304 with a shaping and forming surface 312 and a mated female member 306 with a shaping and forming surface 314. When in their mated position, members 304 and 306, through their respective shaping and forming surfaces 312 and 314, form a passageway 306 of the desired geometry. The passageway 306 in FIG. 6 is U-shaped and is of the same general geometry as the pumptube passageway formed in the peristaltic pumps of FIGS. 1 and 4. Members 304 and 306 also have guide or alinement members 313 (e.g., a pin or other obtrusion in one member and a matching receiving opening or slot in the other member). Members 304 and 306 also have a clamping assembly 310 whereby the members 304 and 306 can be locked together. At least the shaping and forming surfaces 312 and 314 of members 304 and 302, respectively, which form the passageway 306 are preferably of a relatively soft and compressible material (e.g., wood and more preferably a soft wood such as pine) to prevent damage to the pumptube during the forming or shaping operation.

Figure 5B:
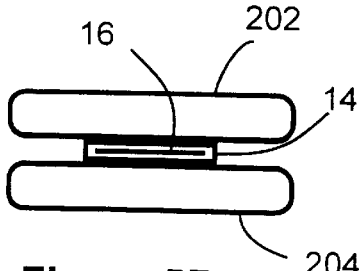
FIG. 5B provides a side view of the pumptube and fixture along section line BB.

To form the shaped pumptube, the heated blank with the flattened pumping section is placed between members 302 and 304 in the shaping fixture so as to fit within the passageway 306. As shown in FIG. 5, the passageway 306 can be formed by matching cavities in the members 302 and 304; alternatively, the passageway 306 can be formed completely in either member 302 or 304. The members 302 and 304 are then quickly brought into their mated position (as shown in FIG. 6A) so as to contain the pumptube blank in the passageway 306; the two members 302 and 304 are then locked into place using clamping assembly 310. Other clamping assembles (such as, for example, clamps, levers, caming mechanisms, air cylinders, solenoid pistons, and the like) can be used. The now formed pumptube is allowed to cool within the clamped fixture.

Of course, it is necessary to maintain the desired fluid passageway (16 in FIG. 2B) during the forming operation. An appropriately shaped core member (not shown) preferably is placed within the blank having a flattened pumping section before the blank is heated such that the heated blank with the heated core is then shaped in fixture 300. The use of such a core helps to prevent obstructions (e.g., crimping or other blockages) within the fluid passageway. Such a core should approximate the desired fluid passageway 16 shape to help form the fluid passageway; of course, such a core should be removable once the pumptube is removed from the fixture. Alternatively, the fluid passageway 16 may be kept open using a pressurized gas (preferably an inert pressurized gas) or liquid (e.g., water) within the fluid passageway during the shaping operation. Generally pressurized gas at about 1 to about 3 atmospheres is sufficient.

It is preferred, especially when the pumptube will be used to pump sensitive or biological fluids, that any core used in preparing the pumptubes of this invention are selected to prevent contamination of the interior of the fluid passageway. Thus, for example in preparing a polytetrafluoroethylene pumptube, the core member can be one or more thin polytetrafluoroethylene tubes or other plastic tubes coated with polytetrafluoroethylene. If a pressured gas is used as the core material to prevent obstruction of the pumptube passageway, it is preferably an inert gas; if water is used, it should be suitably purified. As those skilled in the art will realize, pumptubes can be prepared without using a core member (or other comparable procedures) to prevent or reduce obstruction in the fluid passageway. Such pumptubes, however, are likely to provide less uniform pumping characteristics, reduced pumping rates, and reduced lifetimes. Thus, pumptubes prepared with such core members or using other comparable procedures are preferred.

The locked up fixture containing the pumptube is then allowed to cool to ambient temperatures at which point the pumptube is removed. After removal from the fixture (and, if used, removal of the core), the pumptube is ready for use. If the pumptube is to be stored for later use, it is preferably to effectively "lock" the pumptube in its desired form to prevent the pumptube from gradually losing its desired overall shape. The pumptube can be locked [us]ing, for example, a rubber band, string, or similar connecting device to keep the pumptube legs in the desired position or shape. Alternatively, the formed pumptube can be packaged in a manner to maintain the desired shape; for example, a molded plastic container that has a cavity similar to the pumptube shape could be used.

Of course other methods of forming the pumptubes of this invention can be used if desired. For example, a pumptube blank could be placed within a suitable peristaltic pump and then successively bent around the roller strap-covered pressure rollers to obtain the desired basic U-shape. The flattened portion of the pumptube can then be formed directly in the peristaltic pump by slowly tightening the occlusion bed 38 onto the pumptube to reach complete or essentially complete occlusion while the pump is operated. Preferably a pressurized gas or liquid (e.g., water) is passed through the pumptube as the occlusion bed is tightening onto the pumptube and is continued for about 0.5 to about 1 hour. Alternatively, the basic U-shape can e formed in a fixture similar to that shown in FIG. 6A using essentially the same procedure as described above. Thus, for example, a portion of a pumptube blank, preferably with a removable core in place, could be heated in hot water (generally about 75 to about 100° C.) and then very quickly placed in the fixture to form the desired overall shape (e.g., U-shaped). Once the blank is cooled to room temperature, it could be placed in an operating peristaltic to form the desired flattened portion by slowly tightening the slidable member 32 onto the pumptube to reach complete or essentially complete occlusion while the pump is operated. Preferably a pressurized gas or liquid (e.g., water) is passed through the pumptube as the occlusion bed is tightening onto the pumptube and is continued for about 0.5 to about 1 hour. As those skilled in the art will realize, these alternative forming methods can result in microscopic cracking or other damage, especially at both ends of the flattened pumping section of the pumptube. Thus, the pumptube formation method using fixtures as illustrated in FIGS. 5 and 6 is generally preferred.

The embodiments and drawings described and discussed above are intended to illustrate the present invention and not to limit the scope of the invention which is defined in the appended claims.

That which is claimed is:

1. A peristaltic pump for transporting fluids, said peristaltic pump comprising:

(a) a pump housing containing a pumptube passageway for receiving a pumptube having inlet and outlet ends extending outside the pump housing;

(b) a plurality of pressure rollers rotably mounted within the pump housing to in turn roll along a pumping section of the pumptube so as to transport fluid from the inlet end to the outlet end of the pumptube;

(c) guide cams attached to the pump housing at respective ends of the pumping section for guiding the inlet and outlet ends of the pumptube out of the pump housing;

(d) and an inelastic strap biased against the guide cams and the pressure rollers along the pumping section of the pumptube to prevent excessive expansion of the pumptube between the pressure rollers at the outlet end when exposed to a counter pressure;

wherein at least the pumping section of the pumptube comprises a single rigid fluoroplastic tubing preformed to fit within the pumptube passageway such that the pumptube within the pumping section is flattened into an oval-like shape with an oval-shaped fluid passageway such that the pressure rollers compress the pumping section of the pumptube essentially along the flattened side of the oval-like shape without contacting the pumping section.

2. The peristaltic pump as defined in claim 1 further comprising a biasing assembly to bias the strap against the pressure rollers.

3. The peristaltic pump as defined in claim 2, wherein the biasing assembly contains a spring to bias the strap against the pressure rollers.

4. A peristaltic pump for transporting fluids, said peristaltic pump comprising (a) a pump housing containing a pumptube passageway;

(b) a pumptube to fit within the pumptube passageway, the pumptube having inlet and outlet ends extending outside the pump housing, a pumping section contained within the pumptube passageway, and a fluid passageway extending through the pumptube from the inlet end to the outlet end;

(c) a plurality of pressure rollers rotatably mounted within the housing, whereby each roller in turn compresses the pumping section of the pumptube contained within the pumptube passageway so as to transport fluid from the inlet end to the outlet end of the pumptube;

(d) a first guide cam attached to the pump housing to support the pumping section of the pumptube adjacent to the outlet end; and (e) a strap mounted between the plurality of pressure rollers and the pumping section of the pumptube and between the first guide cam and the outlet end of the pumping section of the pumptube so that the pressure rollers are able to compress the pumping section without directly contacting the pumping section;

wherein at least the pumping section of the pumptube comprises a single rigid fluoroplastic tubing preformed to fit within the pumptube passageway such that the pumptube within the pumping section is flattened into an oval-like shape with an oval-shaped fluid passageway such that the pressure rollers compress the pumping section of the pumptube essentially along the flattened side of the oval-like shape without contacting the pumping section.

5. The peristaltic pump as defined in claim 4 further comprising a biasing assembly to bias the strap against the pressure rollers and the first guide cam.

6. The peristaltic pump as defined in claim 5, wherein the biasing assembly contains a spring to bias the strap against the pressure rollers and the first guide cam.

7. The peristaltic pump as defined in claim 6, wherein a second guide cam is attached to the pump housing to support the pumping section of the pumptube adjacent to the inlet end, such that the roller strap is also mounted between the second guide cam and the inlet end of the pumping section of the pumptube.

8. The peristaltic pump as defined in claim 5, wherein the biasing assembly contains a take-up device to bias the strap against the pressure rollers and the first guide cam and wherein the strap is a continuous loop.

9. The peristaltic pump as defined in claim 8, wherein a second guide cam is attached to the pump housing to support the pumping section of the pumptube adjacent to the inlet end, such that the roller strap is also mounted between the second guide cam and the inlet end of the pumping section of the pumptube.

10. The peristaltic pump as defined in claim 5, wherein a second guide cam is attached to the pump housing to support the pumping section of the pumptube adjacent to the inlet end, such that the roller strap is also mounted between the second guide cam and the inlet end of the pumping section of the pumptube.

11. The peristaltic pump as defined in claim 5, wherein the pumptube is formed from a rigid polytetrafluoroethylene tube with a Shore D hardness of about 25 to about 80, an outer diameter of about 4 to about 25 mm, an inner diameter of about 2 to about 22 mm, and a wall thickness of about 1 to about 2 mm.

12. The peristaltic pump as defined in claim 11, wherein the strap has a width essentially the same as the pressure rollers and wherein the strap is polyester or an aromatic polyamide.

13. The peristaltic pump as defined in claim 12, wherein the pumptube is U-shaped.

14. The peristaltic pump as defined in claim 13, wherein the number of pressure rollers is at least five.

15. The peristaltic pump as defined in claim 12, wherein the oval-like fluid passageway in the pumping section of the pumptube has a minor diameter of about 0.1 to about 4 mm.

16. The peristaltic pump as defined in claim 5, wherein the strap has a width essentially the same as the pressure rollers and wherein the strap is a polyester or an aromatic polyamide.

17. The peristaltic pump as defined in claim 16, wherein the pumptube is U-shaped.

18. The peristaltic pump as defined in claim 17, wherein the number of pressure rollers is at least five.

19. The peristaltic pump as defined in claim 16, wherein the oval-like fluid passageway in the pumping section of the pumptube has a minor diameter of about 0.1 to about 4 mm.

20. The peristaltic pump as defined in claim 4, wherein the pumptube is formed from a rigid polytetrafluoroethylene tube with a Shore D hardness of about 50 to about 65, an outer diameter of about 12 to about 16 mm, an inner diameter of about 10 to about 13 mm, and a wall thickness of about 1 to about 1.5 mm; wherein the strap has a width essentially the same as the pressure rollers; wherein the strap is polyester or an aromatic polyamide; wherein the pumptube is U-shaped; and wherein the number of pressure rollers is five to eight.

21. A peristaltic pump for transporting fluids, said peristaltic pump comprising (a) a pump housing containing a pumptube passageway;

(b) a pumptube having inlet and outlet ends extending outside the pump housing, a pumping section contained within the pumptube passageway, and a fluid passageway extending through the pumptube from the inlet end to the outlet end;

(c) a plurality of pressure rollers rotatably mounted within the housing, whereby each roller in turn compresses the pumping section of the pumptube contained within the pumptube passageway so as to transport fluid from the inlet end to the outlet end of the pumptube; and (d) a strap mounted between the plurality of pressure rollers and the pumping section of the pumptube so that the pressure rollers are able to compress the pumping section without contacting the pumping section;

wherein at least the pumping section of the pumptube comprises a single rigid fluoroplastic tubing preformed to fit within the pumptube passageway such that the pumptube within the pumping section is flattened into an oval-like shape with an oval-shaped fluid passageway such that the pressure rollers compress the pumping section of the pumptube essentially along the flattened side of the oval-like shape without contacting the pumping section.

22. A pumptube system comprising a pumptube and a roller strap, which ystem is suitable for use in a peristaltic pump having a pumptube passageway and a plurality of pressure rollers for compressing the pumptube whereby a fluid can be transferred, wherein the pumptube comprises (a) inlet and outlet ends;

(b) a pumping section located between the inlet and outlet ends; and (c) a fluid passageway extending through the pumptube from the inlet end to the outlet end;

wherein at least the pumping section of the pumptube comprises a single rigid fluoroplastic tubing, wherein the pumptube is preformed to fit within the pumptube passageway such that the pumptube within the pumping section is flattened into an oval-like shape with an oval-like fluid passageway such that the pressure rollers compress the pumping section of the pumptube essentially along the flattened side of the oval-like shape;

and wherein the roller strap comprises an inelastic material to be located between the pressure rollers and the pumping section of the pumptube so that the pressure rollers do not contact the pumping section of the pumptube when the pumping section is compressed.

23. The system as defined in claim 22, wherein the pumptube is formed from a rigid polytetrafluoroethylene tube with a Shore D hardness of about 25 to about 80, an outer diameter of about 4 to about 25 mm, an inner diameter of about 2 to about 22 mm, and a wall thickness of about 1 to about 2 mm; and wherein the strap is polyester or an aromatic polyamide.

24. The system as defined in claim 23, wherein the oval-like fluid passageway has a minor diameter of about 0.1 to about 4 mm; and wherein the pumptube is U-shaped.

25. The system as defined in claim 22, wherein the pumptube is formed from a rigid polytetrafluoroethylene tube with a Shore D hardness of about 50 to about 65, an outer diameter of about 4 to about 25 mm, an inner diameter of about 2 to about 22 mm, and a wall thickness of about 1 to about 1.5 mm; wherein the strap has a width essentially the same as the pressure rollers; wherein the strap is polyester or an aromatic polyamide; wherein the pumptube is U-shaped; and wherein the number of pressure rollers is five to eight.

26. A method of preparing a pumptube suitable for use in a peristaltic pump having a pumptube passageway, a plurality of pressure rollers, an inelastic strap located between the pressure rollers and the pumptube, wherein the pressure rollers, through pressure transferred though the strap, compress the pumptube via the strap without directly contacting the pumptube, whereby a fluid can be transferred, said method comprising (a) forming a length of a rigid fluoroplastic tubing having a fluid passageway extending throughout the length of the rigid fluoroplastic tubing;

(b) placing a central portion of the length of rigid fluoroplastic tubing in a clamping fixture capable of compressing the central portion;

(c) compressing the central portion of the rigid fluoroplastic tubing at or near room temperature using the clamping fixture to form a fully compressed and flattened section in the central portion;

(d) allowing the fully compressed and flattened section to expand to form a flattened, oval-like shaped pumping section with an oval-like fluid passageway therein; and (e) forming the rigid fluoroplastic tubing containing the flattened, oval-like fluid passageway into a shape to fit within the pumptube passageway of the peristaltic pump.

27. The method as defined in claim 26, wherein the rigid fluoroplastic tubing containing the flattened, oval-like fluid passageway is formed into the shape to fit within the pumptube passageway of the peristaltic pump by a method comprising (a) heating at least the pumping section of the rigid fluoroplastic tubing to a temperature sufficient to increase the malleability of the rigid fluoroplastic tubing;

(b) placing the heated rigid fluoroplastic tubing in a molding fixture capable of molding the pumptube into the shape to fit within the pumptube passageway of the peristaltic pump;

(c) molding the pumptube into the shape to fit within the pumptube passageway without obstructing the oval-like fluid passageway; and (d) allowing the pumptube to cool to or near ambient temperature within the molding fixture;

whereby the pumptube fitting within the pumptube passageway of the peristaltic pump is obtained.

28. The method as defined in claim 27, wherein the pumping section of the rigid fluoroplastic tubing is heated to about 75 to about 100° C. to increase the malleability of the rigid fluoroplastic tubing.

29. The method as defined in claim 28, wherein a core is fitted into the oval-like fluid passageway before the rigid fluoroplastic tubing is heated to about 75 to about 100° C. to increase the malleability of the rigid fluoroplastic tubing, wherein the core remains within the oval-like passageway at least through the molding step, whereby the core prevents the obstruction of the oval-like fluid passageway during the molding step.

30. The method as defined in claim 29, wherein the rigid fluoroplastic tubing is a rigid polytetrafluoroethylene tube with a Shore D hardness of about 25 to about 80, an outer diameter of about 4 to about 25 mm, an inner diameter of about 2 to about 22 mm, and a wall thickness of about 1 to about 2 mm; and wherein the pumptube is U-shaped to fit within the pumptube passageway of the peristaltic pump.

31. The method as defined in claim 28, wherein a pressurized gas or liquid is passed through the oval-like passageway during at least the molding step to prevent the obstruction of the oval-like passageway during the molding step.

32. The method as defined in claim 31, wherein the rigid polytetrafluoroethylene tube has a Shore D hardness of about 50 to about 65, an outer diameter of about 12 to about 16 mm, an inner diameter of about 10 to about 13 mm, and a wall thickness of about 1 to about 1.5 mm.

33. The method as defined in claim 31, wherein the pressurized gas is used to prevent the obstruction and wherein the pressurized gas is at a pressure of about 1 to about 3 atmospheres.

34. The method as defined in claim 31, wherein the liquid is used to prevent the obstruction and wherein the liquid is water.

35. The method as defined in claim 34, wherein the rigid polytetrafluoroethylene tube has a Shore D hardness of about 50 to about 65, an outer diameter of about 12 to about 16 mm, an inner diameter of about 10 to about 13 mm, and a wall thickness of about 1 to about 1.5 mm.

36. The method as defined in claim 31, wherein the rigid fluoroplastic tubing is a rigid polytetrafluoroethylene tube with a Shore D hardness of about 25 to about 80, an outer diameter of about 4 to about 25 mm, an inner diameter of about 2 to about 22 mm, and a wall thickness of about 1 to about 2 mm; and wherein the pumptube is U-shaped to fit within the pumptube passageway of the peristaltic pump.

* * * * *

UNITED STATES PATENT AND TRADEMARK OFFICE

CERTIFICATE OF CORRECTION

PATENT NO. : 6,494,693 B1
DATED : December 17, 2002
INVENTOR(S) : Bengt Sundén

It is certified that error appears in the above-identified patent and that said Letters Patent is hereby corrected as shown below:

Title page,
Please change the title from "PERISTATIC PUMP" to -- PERISTALTIC PUMP --.

Column 19,
Line 24, change "ystem" to -- system --.

Signed and Sealed this

Twenty-second Day of April, 2003

JAMES E. ROGAN
*Director of the United States Patent and Trademark Office*